United States Patent [19]

Robison

[11] 4,033,455

[45] July 5, 1977

[54] CONTAINER

[76] Inventor: Charles D. Robison, 4309 Estes Road, Nashville, Tenn. 37215

[22] Filed: Sept. 27, 1976

[21] Appl. No.: 726,846

[52] U.S. Cl. ..... 206/391; 206/386; 206/408; 206/485; 206/493; 206/515

[51] Int. Cl.[2] ..... B65D 85/66; B65D 19/00; B65D 21/04

[58] Field of Search ..... 206/386, 391, 392, 394, 206/403, 404, 408, 3, 515–520, 595–599, 194, 197, 485, 389, 488, 493

[56] References Cited

UNITED STATES PATENTS

| | | | |
|---|---|---|---|
| 2,063,319 | 12/1936 | Lee | 206/392 |
| 2,065,650 | 12/1936 | Burke | 206/597 |
| 2,760,631 | 8/1956 | Stearn | 206/392 |
| 2,764,285 | 9/1956 | Prossen | 206/392 |
| 3,306,439 | 2/1967 | Storey | 206/392 |
| 3,335,858 | 8/1967 | Sibille | 206/392 |
| 3,338,402 | 8/1967 | Becker et al. | 206/597 |
| 3,375,919 | 4/1968 | Schlager et al. | 206/392 |
| 3,392,827 | 7/1968 | Bogren | 206/392 |

FOREIGN PATENTS OR APPLICATIONS

| | | | |
|---|---|---|---|
| 447,877 | 4/1948 | Canada | 206/392 |
| 1,245,324 | 9/1960 | France | 206/392 |
| 836,169 | 4/1952 | Germany | 206/392 |
| 11,655AD | 1906 | United Kingdom | 206/394 |

*Primary Examiner*—Robert S. Ward, Jr.
*Attorney, Agent, or Firm*—Abe Hatcher

[57] ABSTRACT

A container for storage and transportation on end of several rolls of plastic sheet or film, said container having three sides, and at least one end with a plurality of openings therein adapted for an end of each roll to be anchored in each one.

5 Claims, 5 Drawing Figures

10
10a
10b
10c
12
14
16
18
20
22
24
26
28
30
32
34
36
38
40
42
44
46
48
50
52
54
56

CONTAINER

BACKGROUND OF THE INVENTION

1. Field of the Invention

This invention relates to storage and transportation of plastic sheet. More particularly, it relates to a container adapted to prevent damage to rolls of plastic sheet or film, for example, vinyl such as useful in making notebook covers and the like, during storage and transportation.

2. Description of the Prior Art

D. B. Phillips, in U.S. Pat. No. 2,774,474, discloses a boxlike container for transporting artillery shells by fitting one or two between two support members, the bottom one of which has circular seats therein for holding in place the larger ends of said shells and the top one of which has openings for holding in place the opposite smaller tapered ends. Such a system does not work for transporting rolls of plastic sheet the top and bottom of which are substantially the same size. Furthermore, parallel blocks such as proposed by Phillips in said U.S. Pat. No. 2,774,474 are capable of holding only two shells and these only relatively insecurely.

SUMMARY OF THE INVENTION

After extended investigation I have found that rolls of plastic sheet such as vinyl film, may be stored as well as transported with little risk of damage by placing them in a four-sided container three sides of which are enclosed. My container, in cross section, is shaped like part of a polygon, preferably half of a hexagon. The fourth side is open; at least one end has at least three openings therein, preferably more, for anchoring the cores of said rolls therein.

While the three sides may be of metal, wood or plastic, and may be held together in any conventional manner, I prefer to use metal for the sides and angle-iron-like braces, preferably metal, on the inside and outside at angle-iron-like corners where two of the sides meet the third. I also prefer that two of the sides form oblique angles with the third so as to enable fitting the storer/transporters closely together for space saving when empty.

According to a preferred embodiment of my invention, the end with the openings in it, which are preferably of sufficient size for the ends of the cones around which the rolls of sheet are rolled or wrapped to fit snugly therein, is the top. The bottom or platform end of my container preferably has cut-off cones protruding upwardly therefrom for placement of the bottom ends of the cones snugly therearound at substantially flat upper ends of the cut-off cones.

According to a further embodiment of my invention the container rests upon supporting beams which are adapted for insertion of the prongs of a fork lift therebetween for easy loading on a truck bed, railroad car or the like for transportation or storing in a warehouse.

DESCRIPTION OF THE DRAWING AND OF A PREFERRED EMBODIMENT

For a better understanding of my invention, reference will now be made to the drawing in which is depicted a preferred embodiment.

Figures 1, 2, 3, 4, 5:
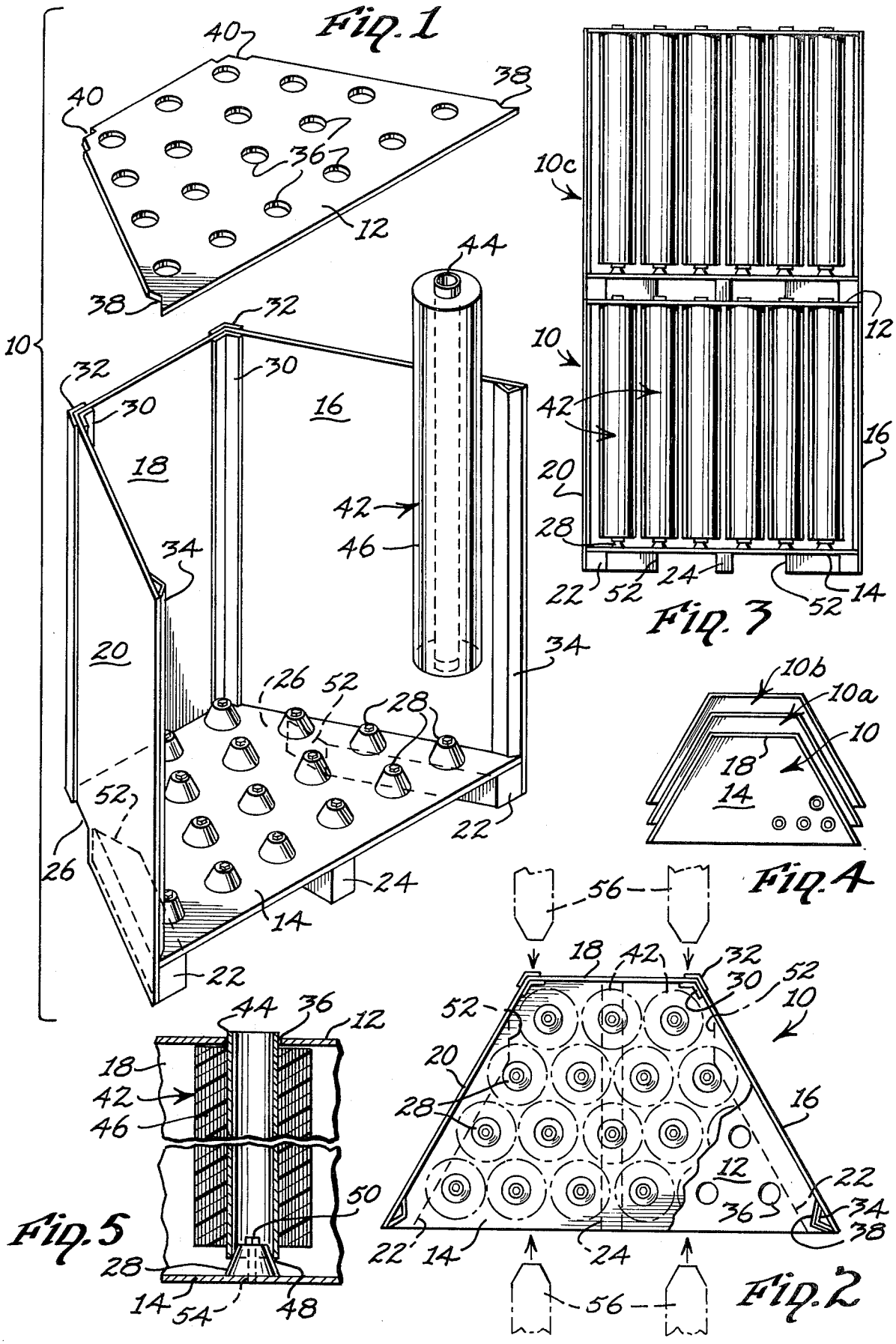
FIG. 1 is an overall split sketch of the film transporter of my invention, with the top or cover and a roll of sheet shown separately for clarity.
FIG. 2 is a top view or view from above of a transporter such as that of FIG. 1 showing the rolls of sheet in place therein and partially cut away to reveal the flat-topped conical holders at the bottom of the transporter.
FIG. 3 is a view from the open end or side of the transporter containing rolls of sheet of the invention and illustrating how two or more transporters may be stacked on top of each other, for example, in a truck.
FIG. 4 is a view showing how two or more empty transporters may be fitted or stacked snugly together for storage or transportation.
FIG. 5 is an enlarged, broken away, cross-sectional view showing a roll of sheet anchored in a transporter such as that depicted in FIGS. 1–3.

Transporter 10, 10A, 10B, 10C is made up principally of a top 12, bottom 14 and three sides 16, 18 and 20, sides 18 and 20 angling out at an oblique angle from side 18. Bottom 14 fits on top of supporting beams 22 and 24. Beam 22 runs along oblique-angled sides 16 and 20, being cut off at an angle at 52 so that bottom 14 extends beyond their angled ends 52 at 26. Beam 24 is centrally placed beneath bottom 14.

Cut-off cones 28 are arranged in substantially parallel rows along bottom 14. The substantially flat tops of these cut-off cones 28, may be held in place by a nut 50 and bolt 54, or smaller screw arrangement, for fitting thereover the ends 48 of core 44 of sheet or film 46 shown in FIG. 5.

Braces or angleiron-like fittings 30, 32 and 34 hold sides 16, 18 and 20 together. Top 12, containing holes 36 for fitting over cores 44, is notched at 38 to match braces 34, and at 40 to match braces 30. Forklift tines 56 are shown in FIG. 2.

In FIG. 1, a roll of film 42 is depicted with sheet 46 wrapped around core 44.

While the invention has been described in terms of preferred embodiments, the claims appended hereto are intended to encompass all embodiments which fall within the spirit of the invention.

Having thus described my invention and certain preferred embodiments thereof, I claim:

1. A film transporter comprising a container having three sides and at least one upright end having a plurality of openings therein adapted for extension therethrough of ends of cores of rolls of sheet and wherein 2 sides of the container extend from the third at oblique angles.

2. The film transporter of claim 1 wherein the said 2 sides are held in position against the third side by an inner and outer brace extending along the length of said sides at the juncture of said 2 sides with said third side.

3. A storage and transporting container comprising 3 sides 2 of which extend at an oblique angle from the third, said container being open at a fourth side, a top having a plurality of substantially parallel rows of openings therein, a bottom having a plurality of rows of cut-off cone-shaped knoblike upper extensions therefrom corresponding to said plurality of rows of openings in said top and supporting beams underneath said bottom.

4. The container of claim 3 wherein said sides are held together by inner and outer braces extending along the length of said sides where said 2 sides join said third side.

5. The container of claim 3 wherein said supporting beams comprise three, one along each of said two sides and the third between the other two, said beams being sufficiently far apart for prongs of a forklift to fit therebetween.

* * * * *